US008567831B2

(12) United States Patent
Roti

(10) Patent No.: US 8,567,831 B2
(45) Date of Patent: Oct. 29, 2013

(54) FOLD AWAY MAGNETIC DOOR STOP

(76) Inventor: Joseph R. Roti, Deerfield, IL (US)

( * ) Notice: Subject to any disclaimer, the term of this patent is extended or adjusted under 35 U.S.C. 154(b) by 643 days.

(21) Appl. No.: 12/795,121

(22) Filed: Jun. 7, 2010

(65) Prior Publication Data

US 2011/0298226 A1 Dec. 8, 2011

(51) Int. Cl.
*E05C 17/56* (2006.01)
*E05C 19/16* (2006.01)

(52) U.S. Cl.
USPC ..... 292/251.5; 292/DIG. 15; 16/86 R; 16/82

(58) Field of Classification Search
USPC ..... 292/251.5, DIG. 15; 16/82, 84, 85, 86 R
See application file for complete search history.

(56) References Cited

U.S. PATENT DOCUMENTS 2,519,435 A * 8/1950 Byrd, Jr. ..... 292/251.5
2,761,718 A * 9/1956 Tool ..... 292/251.5
3,025,559 A * 3/1962 Basinger ..... 16/85
3,244,443 A * 4/1966 Rodgers ..... 292/251.5
3,701,557 A * 10/1972 Centofante et al. ..... 292/251.5
5,010,622 A * 4/1991 Morita ..... 16/85
5,082,317 A 1/1992 Delaney
5,771,533 A * 6/1998 Kuang-Pin ..... 16/82
6,588,811 B1 * 7/2003 Ferguson ..... 292/251.5
7,017,229 B2 * 3/2006 Walcome ..... 16/82
7,024,726 B1 * 4/2006 Cornell ..... 16/82
7,536,746 B2 * 5/2009 Rutledge et al. ..... 16/82
8,240,722 B2 * 8/2012 Dieling et al. ..... 292/90

* cited by examiner

*Primary Examiner* — Carlos Lugo
*Assistant Examiner* — Mark Williams
(74) *Attorney, Agent, or Firm* — Bryan Cave LLP

(57) ABSTRACT

Door stop assemblies are disclosed, which generally include a door stop that includes a stem portion, a distal side that includes a first magnetic element, and a proximal side. The door stop further includes at least one hinge located between the distal side and proximal side thereof. In addition, the assemblies further include a door stop receiving element that is equipped with a spring and a second magnetic element that is magnetically attracted to the first magnetic element.

8 Claims, 3 Drawing Sheets

FOLD AWAY MAGNETIC DOOR STOP

FIELD OF THE INVENTION

The field of the present invention relates to door stops and related mechanisms. More particularly, the field of the present invention relates to door stop assemblies that employ the use of at least one magnet and at least one hinge.

BACKGROUND OF THE INVENTION

Over the years, a variety of different door stops have been developed and placed into use, ranging from the very simple door stop (consisting of a basic coiled spring with a rubber tip) to more complex magnetic door stops. Despite the existence of a large variety of door stops, there continues to be a need for a magnetic door stop that is effective to not only hold a door in an open state, but also allow a door to be pushed (and held in an open position) that is closer to a wall (e.g., in order to maximize the entry space of a doorway).

The present invention addresses such demands, and provides other benefits that are not provided by currently-available door stop assemblies.

SUMMARY OF THE INVENTION

According to certain aspects of the present invention, door stop assemblies are provided, which generally comprise a door stop component that includes a stem portion, a distal side that includes a first magnetic element, and a proximal side. The door stop further includes at least one hinge (i.e., one or multiple hinges) located between the distal side and proximal side thereof. In addition, the assemblies further comprise a door stop receiving element that is equipped with at least one spring and a second magnetic element that is magnetically attracted to the first magnetic element (located in the door stop).

The above-mentioned and additional features of the present invention are further illustrated in the Detailed Description contained herein.

DETAILED DESCRIPTION OF THE INVENTION

Figure 1:
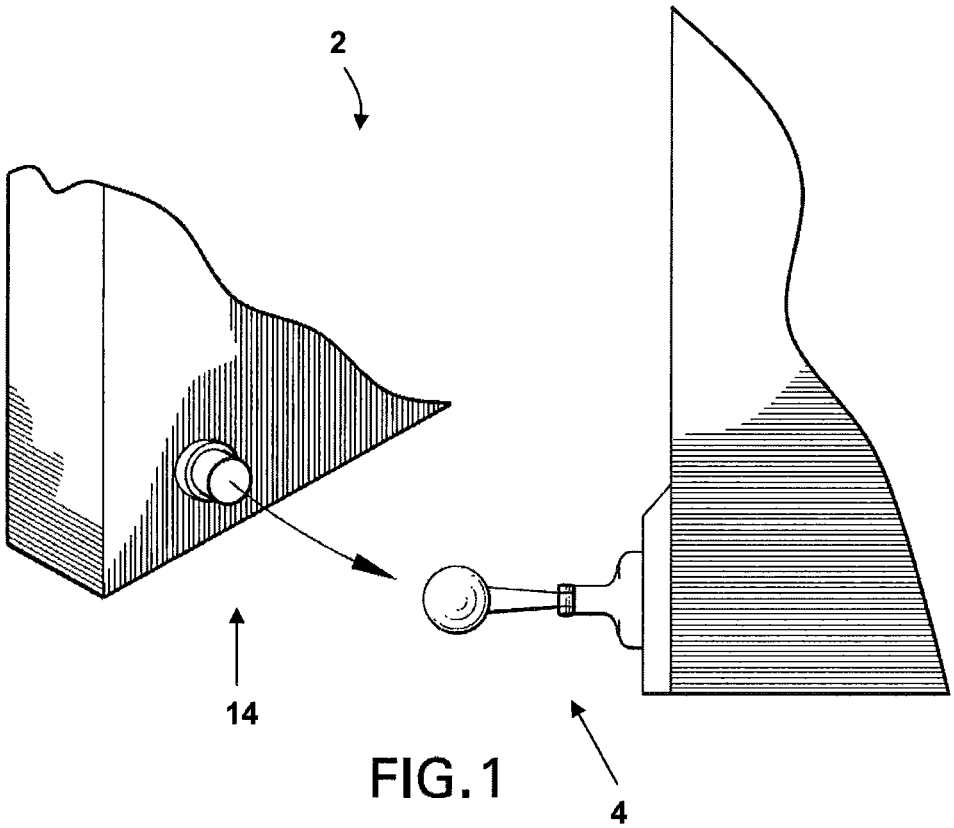
FIG. 1 is an illustration that shows the interaction between the door stop and the door stop receiving element described herein.
Figure 2:
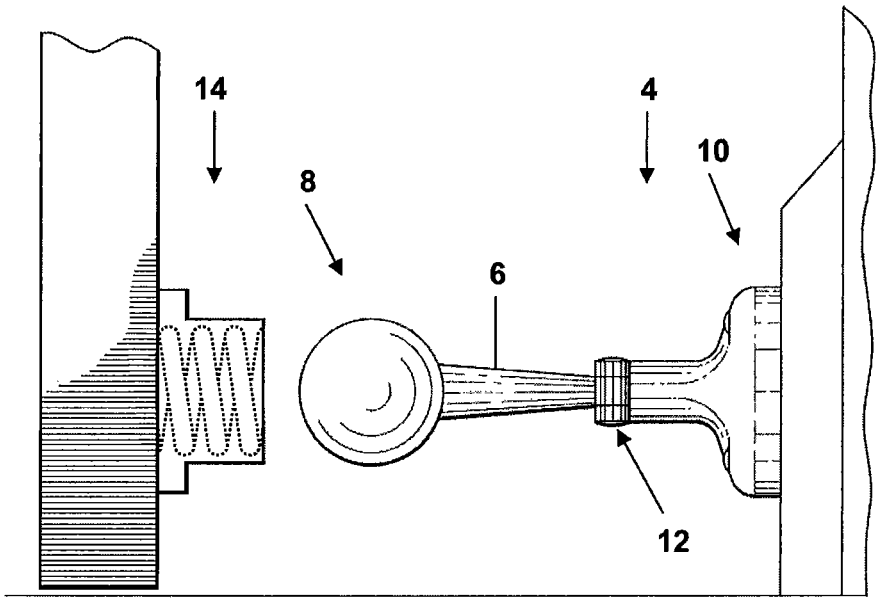
FIG. 2 is a side view of the door stop and the door stop receiving element described herein.
Figure 3:
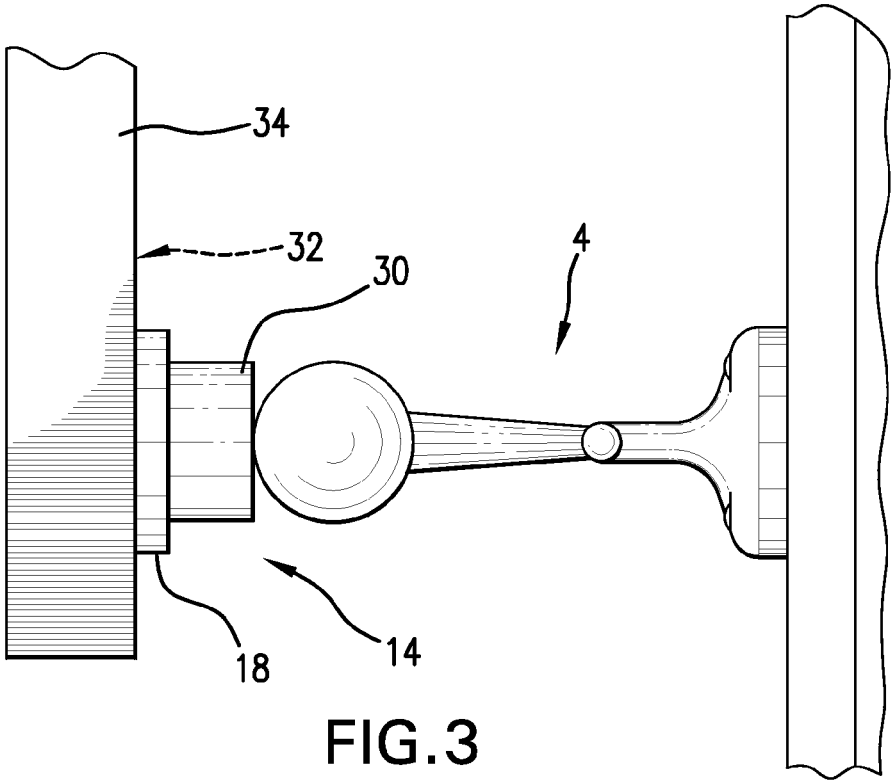
FIG. 3 is a topside view of the door stop and the door stop receiving element described herein, with the door stop making contact with the door stop receiving element.
Figure 4:
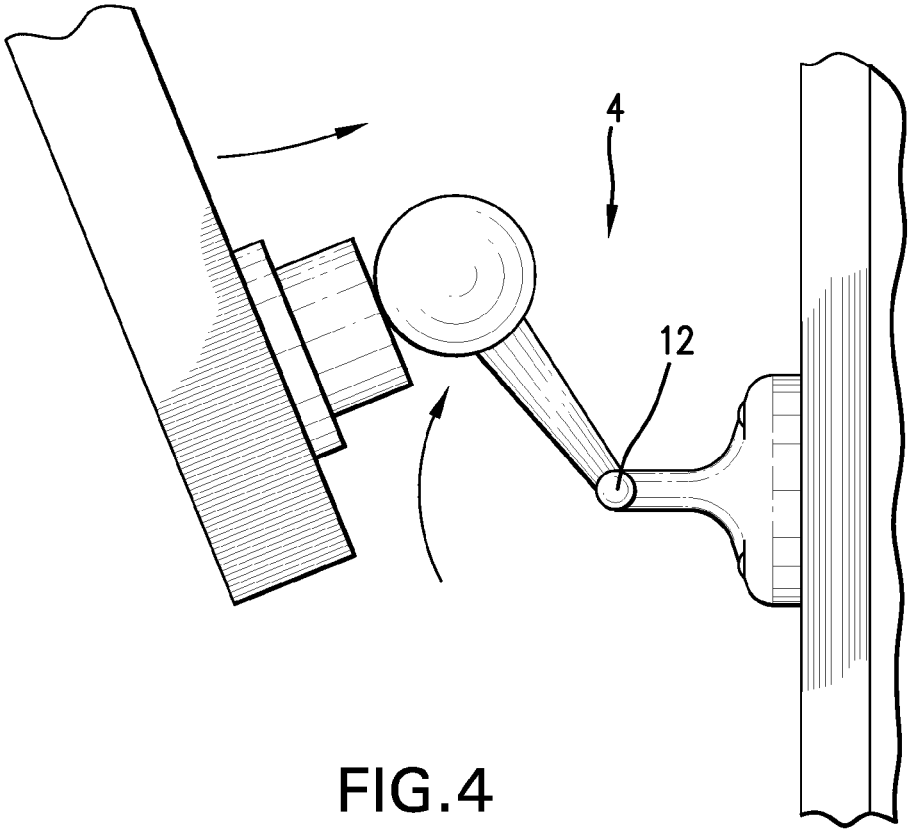
FIG. 4 is a topside view of the door stop and the door stop receiving element described herein, with the door stop making contact with the door stop receiving element and causing the door stop to rotate about a hinge.

The following will describe in detail several preferred embodiments of the present invention. These embodiments are provided by way of explanation only, and thus, should not unduly restrict the scope of the invention. In fact, those of ordinary skill in the art will appreciate upon reading the present specification and viewing the present drawings that the invention teaches many variations and modifications, and that numerous variations of the invention may be employed, used, and made without departing from the scope and spirit of the invention.

According to certain preferred embodiments of the present invention, and referring to FIGS. 1-7, door stop assemblies 2 are provided, which generally include a door stop 4 that comprises a stem portion 6, a distal side 8 that comprises a first magnetic element, and a proximal side 10 (which is affixed to a wall or door). The door stop 4 further comprises a hinge 12 (or multiple hinges), which preferably allows the door stop 4 to swing horizontally (parallel with a floor surface) within a 180-degree range of motion, as described herein and illustrated in FIG. 4. In certain alternative embodiments, however, the door stop 4 shown in FIG. 4 may be oriented in such a way, e.g., by rotating the door stop 4 90-degrees, such that the hinge 12 allows the door stop 4 to swing vertically (perpendicular with a floor surface). The first magnetic element may be located within, and/or on the surface of, the distal side 8 of the door stop 4. The door stop assemblies 2 further comprise a door stop receiving element 14 that comprises a spring and a second magnetic element that is magnetically attracted to the first magnetic element.

Figure 5:
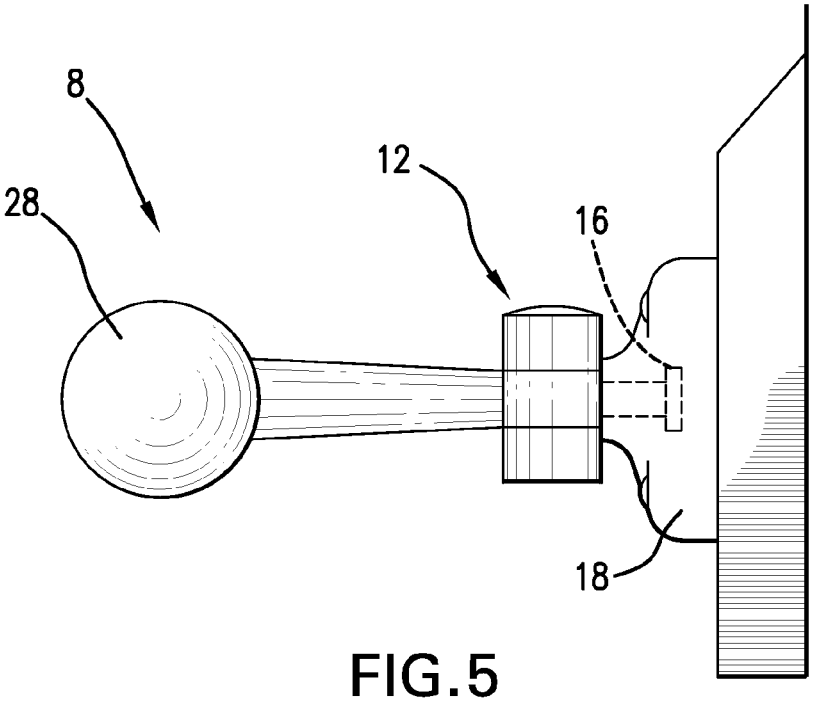
FIG. 5 is a side view of the door stop described herein, which includes a cutaway view of the interlocking terminal side thereof.
Figure 6:
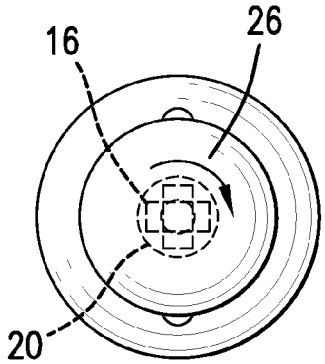
FIG. 6 is a drawing that illustrates how the interlocking terminal side of the door stop may be maneuvered to lock the door stop into position—or to remove the door stop from a wall or door.
Figure 7:
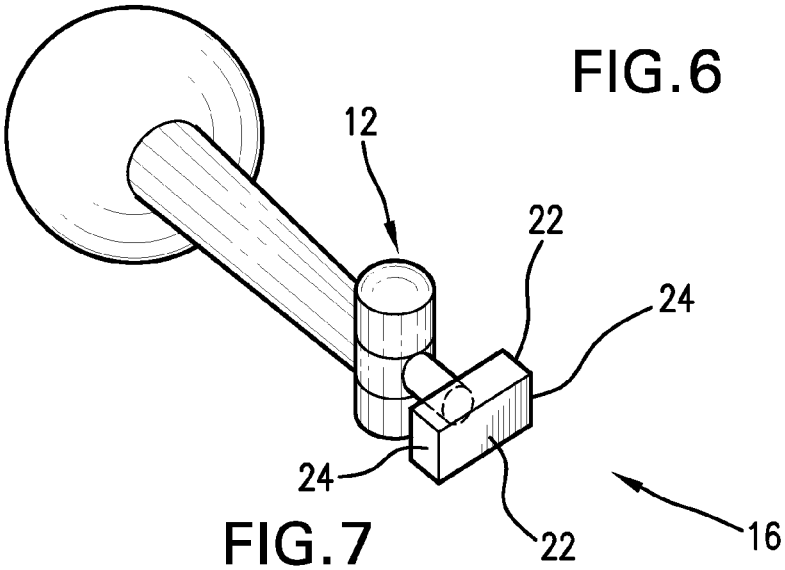
FIG. 7 is a perspective view of the door stop described herein.

Referring now to FIGS. 5-7, the proximal side 10 of the door stop 4 comprises an interlocking element 16 that may be disposed through an aperture 20 located in a base portion 18, rotated 26 approximately ninety-degrees, and reversibly connected to the base portion 18. According to such embodiments, the interlocking element 16 preferably comprises a rectangular shape (element), having a first pair of parallel sides 22 that are greater in length than a second pair of parallel sides 24. The invention provides that the aperture 20 of the base portion 18 will be adapted to receive the interlocking element 16, and will exhibit a rectangular dimension that is slightly larger than the dimension of the interlocking element 16, such that the interlocking element 16 may be disposed therethrough in a first orientation. In other words, according to such embodiments, the aperture 20 will have a first pair of parallel sides that are greater in length than a second pair of parallel sides, which are configured to be slightly larger than the corresponding sides of the rectangularly-shaped interlocking element 16.

As illustrated in FIG. 6, such embodiments allow the interlocking element 16 to be disposed through the aperture 20 in a first orientation and rotated approximately ninety-degrees 26 (to position the interlocking element 16 in a second orientation) in order to reversibly connect the proximal side 10 of the stem portion 6 to the base portion 18, i.e., the interlocking element 16 would not be able to be pulled back through the aperture 20 in the second orientation, unless and until it is rotated back the other way approximately ninety-degrees (to position the interlocking element 16 in the first orientation). The invention provides that such configuration allows a user to reversibly connect different door stops 4, which may exhibit different shapes, sizes, and aesthetics, to a base portion 18. The invention provides that the base portion 18 may be attached to a wall or door vis-à-vis nails, screws, other mechanical attachments, adhesives, or combinations thereof.

The invention provides that, in certain preferred embodiments, the distal side 8 of the stem portion 6 will comprise a spherically-shaped cap 28 (FIG. 5). However, in certain alternative embodiments, the cap may exhibit other shapes and sizes—or may be collinear with the other parts of the stem portion 6. As explained above, the invention provides that the door stop receiving element 14 will preferably comprise a base portion 18 that is adapted to be attached to a wall or door. In addition, the door stop receiving element 14 will preferably comprise a movable surface 30 (FIG. 3) that is operably connected to a spring. According to such embodiments, the spring is housed within the door stop receiving element 14, which allows the movable surface 30 to move in a plane 32 (FIG. 3) that is perpendicular to a surface of the wall or door 34. According to such embodiments, the movable surface 30 will preferably reside within (or be surrounded by) the base portion 18 of the door stop receiving element 14.

The invention provides that the first magnetic element will comprise a magnetic material (e.g., disposed at the distal side 8 of the door stop 4), whereas the second magnetic element will comprise a metallic material that is magnetically attracted to the magnetic material (e.g., disposed in the door stop receiving element 14). According to such embodiments, the distal side 8 of the door stop 4 will be magnetically attracted to the door stop receiving element 14, such that a door may be held in an open position as desired (and closed by pulling the door away from the door stop receiving element 14 with a modest amount of force to break the magnetic attraction between the door stop 4 and the door stop receiving element 14). Those of ordinary skill in the art will appreciate that, alternatively, the first magnetic element may comprise a metallic material, whereas the second magnetic element may comprise a magnetic material that is magnetically attracted to the metallic material. Importantly, as explained above and referring to FIGS. 3 and 4, when the distal side 8 of the door stop 4 makes contact with the movable surface 30 of the door stop receiving element 14, a magnetic force (attraction) exists between the door stop 4 and the door stop receiving element 14 to connect such components to each other.

According to certain preferred embodiments of the invention, the at least one hinge 12 is located at a point between the proximal 10 and distal end 8 of the door stop 4. In certain embodiments, the hinge 12 is configured to be locked into one or more positions within the 180-degree range of motion described herein, such as perpendicular with a wall or door, or at a position that is 45-degrees relative to the plane of a wall or door (and/or other angles). The invention further provides that although FIG. 1 depicts the door stop 4 being attached to a wall, and the door stop receiving element 14 being attached to a door, in certain alternative embodiments, the door stop 4 may be attached to a door, and the door stop receiving element 14 may be attached to a wall. The invention provides that the door stop 4 and the door stop receiving element 14 may be constructed from various materials, such as plastics, metals, wood, and/or other materials (in addition to the use of the magnetic and metallic materials described herein).

Although illustrative embodiments of the present invention have been described herein, it should be understood that the invention is not limited to those described, and that various other changes or modifications may be made by one skilled in the art without departing from the scope or spirit of the invention.

What is claimed is:

1. A door stop assembly comprising:

(a) a door stop that comprises a stem portion, a distal side of the stem portion that comprises a first magnetic element, a proximal side of the stem portion that comprises an interlocking element disposed through an aperture located in a base portion in a first orientation and rotatable to a second orientation, wherein the interlocking element comprises a rectangular element having a first pair of parallel sides that are greater in length than a second pair of parallel sides and the aperture located in the base portion exhibits a rectangular dimension having a first pair of parallel sides that are greater in length than a second pair of parallel sides, such that the interlocking element may be disposed through the aperture in the first orientation, but not the second orientation, and a hinge located between the distal side and proximal side of the stem portion wherein the hinge is configured to allow the stem portion to swing horizontally and parallel with a floor, within a 180-degree range of motion; and (b) a door stop receiving element that comprises a spring and a second magnetic element that is magnetically attracted to the first magnetic element.

2. The door stop assembly of claim 1, wherein the distal side of the stem portion comprises a spherically-shaped cap.

3. The door stop assembly of claim 1, wherein the door stop receiving element comprises:

(a) a base portion that is adapted to be attached to a wall or door; and (b) a movable surface that is operably connected to the spring, which allows the movable surface to move in a plane that is perpendicular to a surface of the wall or door.

4. The door stop assembly of claim 3, wherein the movable surface resides within the base portion.

5. The door stop assembly of claim 1, wherein the first magnetic element comprises a magnetic material, and the second magnetic element comprises a metallic material that is magnetically attracted to the magnetic material.

6. The door stop assembly of claim 1, wherein the door stop is attached to a wall and the door stop receiving element is attached to a door.

7. The door stop assembly of claim 1, wherein the spring allows the movable surface of the door stop receiving element to move perpendicularly with the plane of the door.

8. The door stop assembly of claim 1, is configured to be locked into two or more positions within the 180-degree range of motion.

* * * * *